US010590616B1

(12) United States Patent
Kodi

(10) Patent No.: US 10,590,616 B1
(45) Date of Patent: Mar. 17, 2020

(54) PROTECTIVE BARRIER AND A CORRESPONDING STRUCTURE

(71) Applicant: Jon Kodi, Lebanon, TN (US)

(72) Inventor: Jon Kodi, Lebanon, TN (US)

( * ) Notice: Subject to any disclaimer, the term of this patent is extended or adjusted under 35 U.S.C. 154(b) by 0 days.

(21) Appl. No.: 15/728,146

(22) Filed: Oct. 9, 2017

Related U.S. Application Data

(60) Provisional application No. 62/408,528, filed on Oct. 14, 2016.

(51) Int. Cl.
*E01F 15/14* (2006.01)

(52) U.S. Cl.
CPC ..... *E01F 15/146* (2013.01); *E01F 15/141* (2013.01)

(58) Field of Classification Search
CPC ..... E01F 13/12; E01F 13/02; E01F 15/088; E01F 15/006; E01F 15/0492; E01F 15/086; E01F 15/146; E01F 15/143; E01F 15/141
See application file for complete search history.

(56) References Cited

U.S. PATENT DOCUMENTS 2,603,455 A 7/1952 Welch
3,928,701 A * 12/1975 Roehner ..... B63B 59/02 428/222
3,951,384 A * 4/1976 Hildreth, Jr. ..... E01F 15/003 256/1
4,000,882 A 1/1977 Penton
4,030,706 A * 6/1977 Ward ..... E01F 15/0453 114/219
4,057,141 A * 11/1977 Laurie ..... B65D 71/02 100/12
4,095,560 A * 6/1978 Laurie ..... B65D 71/02 119/222
5,156,486 A * 10/1992 Davidson ..... E01F 9/612 116/63 P
5,229,183 A * 7/1993 Eastman ..... B60P 7/12 156/92
5,236,756 A * 8/1993 Halliburton ..... E01F 5/005 156/95
5,238,228 A * 8/1993 Moon ..... E01F 15/145 256/1
5,284,326 A * 2/1994 Chiovitti ..... E01F 15/003 256/1
5,285,616 A 2/1994 Tripp
5,340,630 A 8/1994 Tripp
(Continued)

FOREIGN PATENT DOCUMENTS

AU 7791194 B2 9/2010
CA 2160584 A1 10/1994
(Continued)

*Primary Examiner* — Abigail A Risic
(74) *Attorney, Agent, or Firm* — Lucian Wayne Beavers; Alex H. Huffstutter; Patterson Intellectual Property Law, PC

(57) ABSTRACT

A method of fitting a protective barrier on a structure base. The method may include removing a first sidewall from a tire. A line may be cut spanning from an outer diameter of the sidewall to an inner diameter of the sidewall such that the sidewall includes sidewall ends and the sidewall is no longer a continuous loop. The sidewall ends may be bent away from each other to widen a gap between the sidewall ends. The sidewall may be placed around the structure base by moving the sidewall relative to the structure base such that the structure base passes through the gap and into an inner opening of the sidewall.

11 Claims, 8 Drawing Sheets

(56) References Cited

U.S. PATENT DOCUMENTS

| | | | | |
|---|---|---|---|---|
| 5,412,921 | A | 5/1995 | Tripp | |
| 5,429,449 | A | 7/1995 | Baatz | |
| 5,588,538 | A * | 12/1996 | Rundle | B09B 1/00 206/304.2 |
| 5,613,798 | A * | 3/1997 | Braverman | E01F 9/688 116/63 C |
| 5,718,166 | A * | 2/1998 | Phillips | B65B 27/06 100/12 |
| 5,755,528 | A * | 5/1998 | Kulp | E01F 9/688 116/63 P |
| 5,834,083 | A | 11/1998 | Pignataro, Jr. | |
| 5,915,880 | A * | 6/1999 | Nordberg | E01F 5/005 138/155 |
| 6,258,193 | B1 | 7/2001 | Coffin | |
| 6,306,484 | B1 | 10/2001 | Bove et al. | |
| 6,372,069 | B1 | 4/2002 | Walls | |
| 6,604,888 | B2 * | 8/2003 | Dolan | E01F 15/146 404/10 |
| 6,670,003 | B1 * | 12/2003 | Schmeling | B26D 3/005 428/35.7 |
| 6,692,047 | B1 | 2/2004 | Solon | |
| 7,186,449 | B1 * | 3/2007 | Hansen | B32B 1/08 156/184 |
| 8,434,965 | B2 * | 5/2013 | Chae | E01F 15/003 256/13.1 |
| 2003/0010421 | A1 | 1/2003 | Coffin et al. | |
| 2005/0152743 | A1 | 7/2005 | Kasraie | |
| 2007/0140790 | A1 * | 6/2007 | Lotsberg | E01F 15/0453 404/6 |
| 2009/0266472 | A1 | 10/2009 | Martinez-Alvaro et al. | |

FOREIGN PATENT DOCUMENTS

| | | | |
|---|---|---|---|
| CA | 2124401 | C | 9/1999 |
| CH | 618488 | A5 | 1/1899 |
| DE | 4116317 | A1 | 11/1992 |
| DE | 4320722 | A1 | 2/1994 |
| DE | 9313884 | U1 | 1/1995 |
| ES | 2191517 | A1 | 9/2003 |
| FR | 2460365 | A1 | 1/1981 |
| FR | 2754553 | A1 | 4/1998 |
| SE | 502091 | A | 7/1893 |
| WO | 9417246 | A1 | 8/1994 |

* cited by examiner

PROTECTIVE BARRIER AND A CORRESPONDING STRUCTURE

BACKGROUND

The present disclosure relates generally to utilizing rubber recycled from vehicle tires. More particularly, the present disclosure pertains to a protective barrier and a corresponding structure base.

Structure bases and structures such as light poles for use in parking lots and near roadways are known in the art. These structures and structure bases are typically made from concrete, metal, or some combination thereof. The structures and bases, although resilient and long-lasting, typically cause extensive damage to vehicles in even low-speed collisions.

The reported recycling rate of tires in 2012 was 44.6%. In recent years, many states have banned whole tires from entering landfills. In some of such states, the tires must be at least quartered prior to sending them to a landfill. Uses for old tires have been found to solve this problem including grinding up the rubber for use as mulch in playgrounds. Used tires numbering in the hundreds of millions per month in the United States must be processed and preferably at least partially recycled.

What is needed, therefore, is a protective barrier that is effective for at least low speed collisions and may optionally utilize recycled rubber from vehicle tires.

BRIEF SUMMARY

Briefly, the present disclosure relates, in one embodiment, to a method of fitting a protective barrier on a structure. The method may include removing a first sidewall from a tire. A line may be cut spanning from an outer diameter of the sidewall to an inner diameter of the sidewall such that the sidewall includes sidewall ends and the sidewall is no longer a continuous loop. The sidewall ends may be bent away from each other to widen a gap between the sidewall ends. The sidewall may be placed around the structure by moving the sidewall relative to the structure such that the structure passes through the gap and into an inner opening of the sidewall.

An alternative embodiment includes repeating the above steps with successive sidewalls and stacking the successive sidewalls on the first sidewall such that a plurality of sidewalls is disposed around the structure.

Another embodiment includes fastening the sidewalls to each other.

Still another embodiment includes stacking the successive sidewalls including staggering the cut lines of the sidewalls such that most of the cut lines do not align.

Yet another embodiment includes cutting the outer diameter of each of the sidewalls to a common outer diameter.

A further embodiment includes aligning the outer diameters of the stacked sidewalls.

A further still embodiment includes aligning the inner diameters of the stacked sidewalls.

Still another embodiment includes aligning the inner diameters of the stacked sidewalls including closely fitting the sidewalls to the structure.

One embodiment includes stacking the successive sidewalls including stacking only sidewalls that have substantially similar inner diameters.

A further embodiment includes covering the sidewall with an ultraviolet protective layer.

An even further embodiment includes cutting the line along a radius of the sidewall.

The present disclosure also relates, in an embodiment, to a method of fitting a protective barrier on a structure base. The method includes removing a plurality of sidewalls from respective tires; stacking the plurality of sidewalls around the structure base with the structure base received in an inner opening of the plurality of sidewalls; and attaching a structure to the structure base.

Another embodiment includes splitting each of the plurality of sidewalls from an outer diameter of each sidewall to the inner opening of each sidewall and stacking the plurality of sidewalls around the structure base after attaching a structure to the structure base.

Yet another embodiment includes covering the plurality of sidewalls with an ultraviolet protective layer.

Still another embodiment includes leaving the sidewalls uncut and stacking the plurality of sidewalls around the structure base before attaching a structure to the structure base.

The present disclosure also relates, in an embodiment, to a protective barrier and structure base assembly. The assembly includes a structure base. At least one sidewall is removed from a tire and fitted on the structure base. The at least one sidewall substantially surrounds the structure base. The at least one sidewall also includes a slit from a sidewall inner diameter to a sidewall outer diameter.

A further embodiment includes a plurality of sidewalls removed from respective tires and fitted on the structure base, the plurality of sidewalls stacked on top of each other.

Another embodiment includes each of the plurality of sidewalls including the slit from the sidewall inner diameter to the sidewall outer diameter. Each slit is substantially unaligned with a majority of slits of the plurality of sidewalls.

Still another embodiment includes an ultraviolet protective layer covering a portion of the at least one sidewall.

Yet another embodiment includes a structure attached to the structure base.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

The word "fastener" should be interpreted to mean any mechanical components that allow for one article to either permanently or temporarily be attached to another article. "Fasteners" may include, but are not limited to, bolts, screws, nuts, nails, tacks, staples, rivets, clamps, clips, sections of hooks and loops, ties, buttons, hooks, sewn thread or cordage, detent engagements, folds, pins, any combination thereof, and the like.

The word "recycled" should be interpreted to mean any appropriate use of an article that may otherwise be discarded. "Recycling" may include finding a use for a rejected item, utilizing a previously used item, combining parts from a series of discarded items, and the like.

Figure 1:
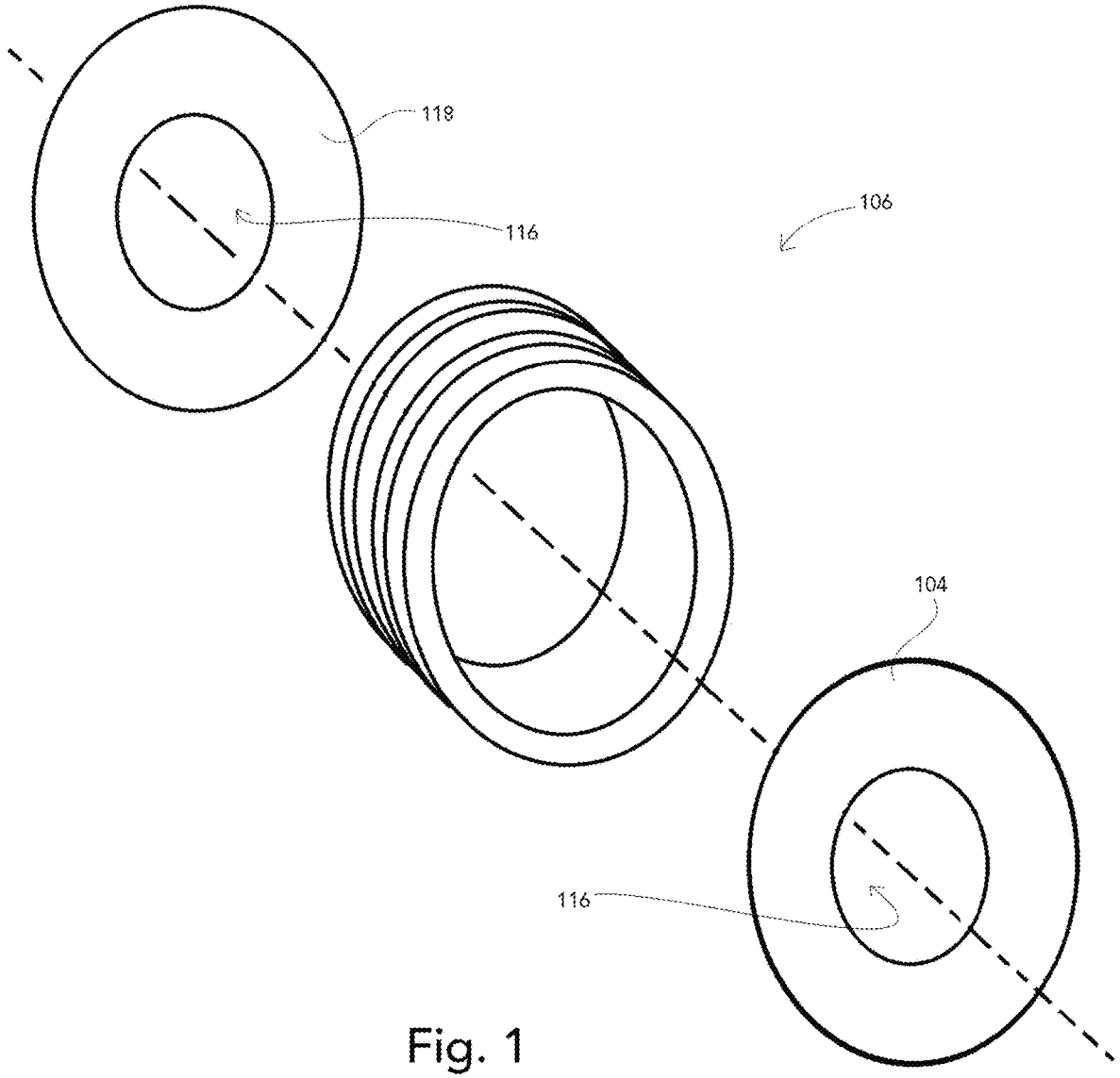
FIG. 1 is a perspective view of a tire with its sidewalls having been removed from the corresponding tread section.
Figure 6:
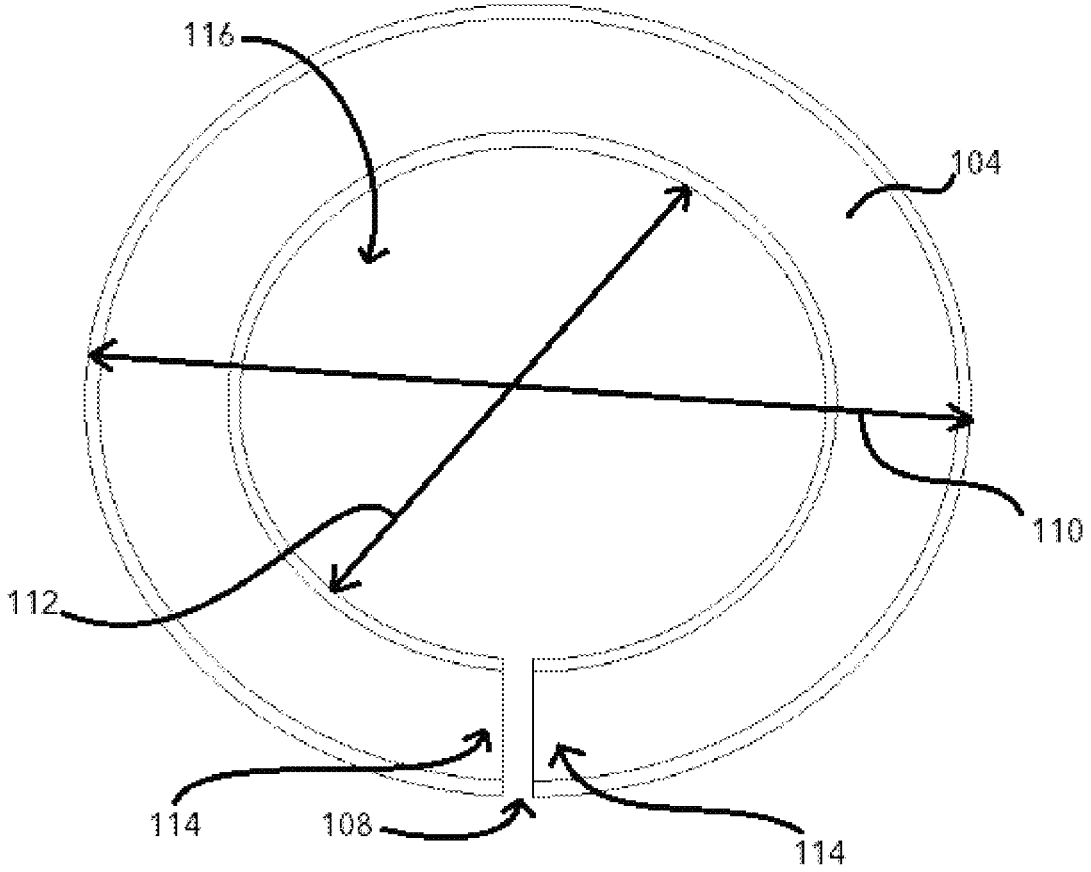
FIG. 6 is a top plan view of a sidewall removed from the tire of FIG. 1 with a cut line spanning from the inner diameter to the outer diameter.
Figure 7:
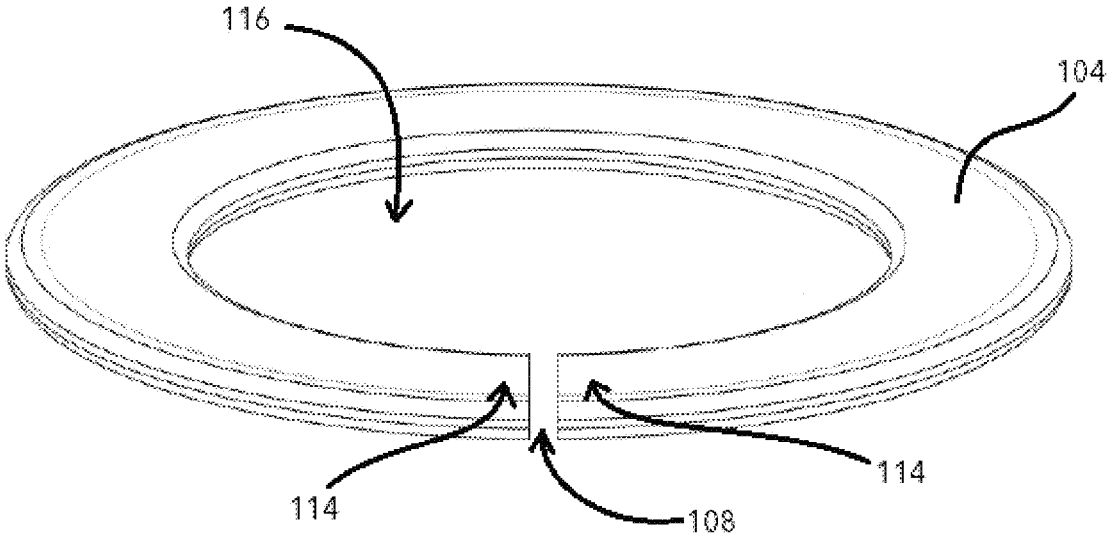
FIG. 7 is a perspective view of the sidewall of FIG. 6.

Turning now to the Figures, the present disclosure relates, in one embodiment, to a method of fitting a protective barrier 100 on a structure base 102. A first sidewall 104 may be removed from a tire 106 as shown in FIG. 1. The first sidewall 104 may be cut along a line such that a gap, or slit, 108 spans from an outer diameter 110 to an inner diameter 112 of the sidewall. In such an embodiment, the sidewall 104 may no longer be a continuous loop and may include sidewall ends 114 as shown in FIGS. 6 and 7. The cut line, or gap, 108 may be any appropriate shape or size and may be curved, angled, and the like. Alternatively, the cut line, or gap, 108 may be a straight line cut along a radius of the sidewall 104. The sidewall ends 114 may be bent away from each other to widen the gap 108 between the sidewall ends. This bending motion may include twisting the sidewall 104, folding the sidewall on itself, pulling the ends 114 of the sidewall apart in a lateral direction, and the like. With the sidewall ends 114 bent away from each other, the sidewall 104 may be placed around the structure base 102 by moving the sidewall relative to the structure base such that the structure base passes through the gap 108 and into an inner opening 116 of the sidewall. Alternatively, the sidewall ends 114 may be flexed just enough to pass the structure 120 such that the structure passes through the gap 108 and into the inner opening 116 of the sidewall 104. The first sidewall 104 may be the only sidewall received around the structure base 102.

A further embodiment may include repeating the above steps with successive sidewalls 118. The successive sidewalls 118 may be stacked on the first sidewall 104 such that a plurality of the sidewalls is disposed around the structure base 102. The sidewalls 104, 118 may be fastened to each other in some embodiments. In many embodiments including fastening the sidewalls 104, 118 to each other, the sidewalls may be unfastened prior to fitting them on the structure base 102 and fastened subsequently. Some embodiments may include fastening a few of the sidewalls 104, 118 to each other such that small batches of fastened sidewalls may be fitted to the structure base 102. One embodiment may include all the sidewalls 104, 118 to be used on a given structure base 102 fastened to each other prior to installation on the structure base 102. One or more tools may be necessary to widen the gap 108 of the plurality of sidewalls 104, 118 in such an embodiment, however.

The stacked sidewalls 104, 118 may be placed such that the cut lines, or gaps, 108 of most of the sidewalls do not align with each other. The plurality of sidewalls 104, 118 may also be cut such that the outer diameters 110 of the sidewalls are a common outer diameter. In such an embodiment, the outer diameters 110 may be aligned when the sidewalls 104, 118 are stacked. In some embodiments, the outer diameters 110 may be left at the original lengths from when the sidewalls 104, 118 were removed from their corresponding tires 106. The stack of sidewalls 104, 118 may alternatively or additionally be positioned such that the inner diameters 112 of the sidewalls are aligned. Aligning the inner diameters 112 may include closely fitting the sidewalls 104, 118 to the structure base 102.

The sidewalls 104, 118 may be sourced from tires 106 that are substantially similar in size. In such embodiments, stacking the sidewalls 104, 118 may include stacking only sidewalls that have substantially similar inner diameters 112, substantially similar outer diameters 110, or both. The inner diameters 112 may already be the same or similar distances, but the inner diameters may alternatively be cut to a common distance from tires 106 of varying sizes.

The resulting protective barrier 100 of any of the embodiments may include an ultraviolet protective layer 122 covering the at least one sidewall 104. The ultraviolet protective layer 122 may include a coating of paint, a slip cover, additional shock-absorbent structures, and the like. The ultraviolet protective layer 122 may help prevent further degradation of the sidewalls 104, 118.

Figure 2:
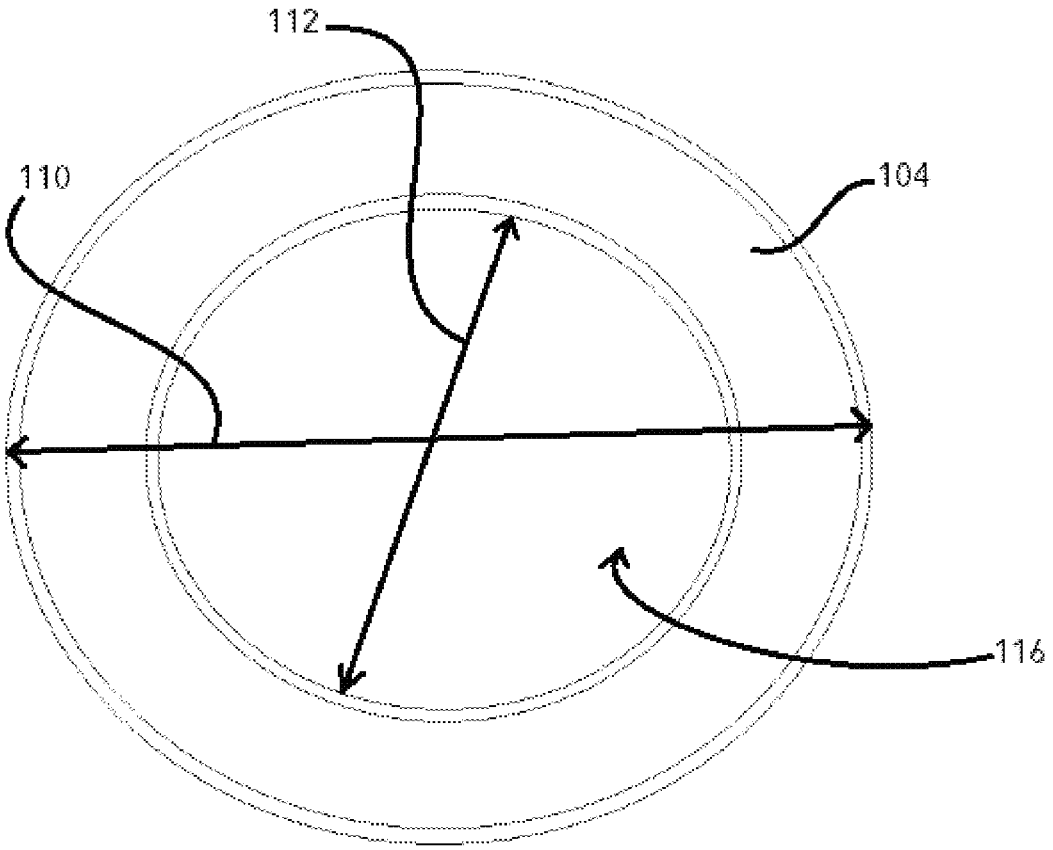
FIG. 2 is a top plan view of a sidewall removed from the tire of FIG. 1.
Figure 3:
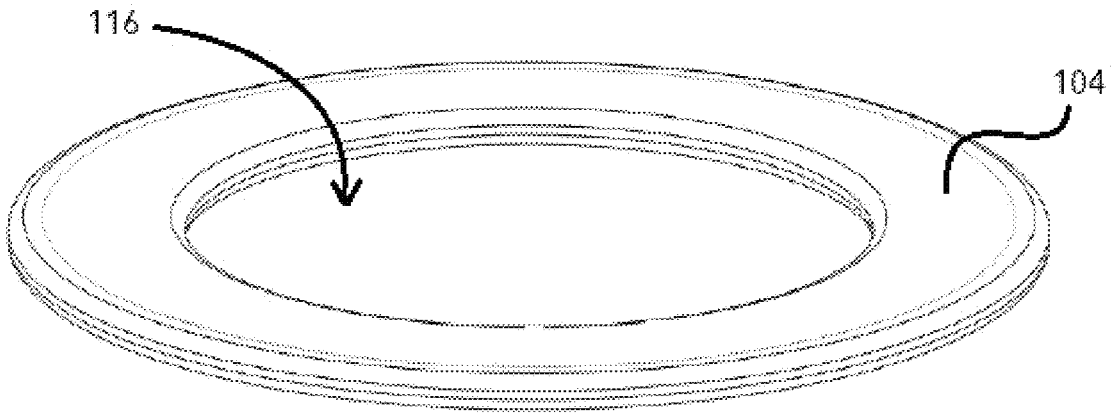
FIG. 3 is a perspective view of the sidewall of FIG. 2.
Figure 4:
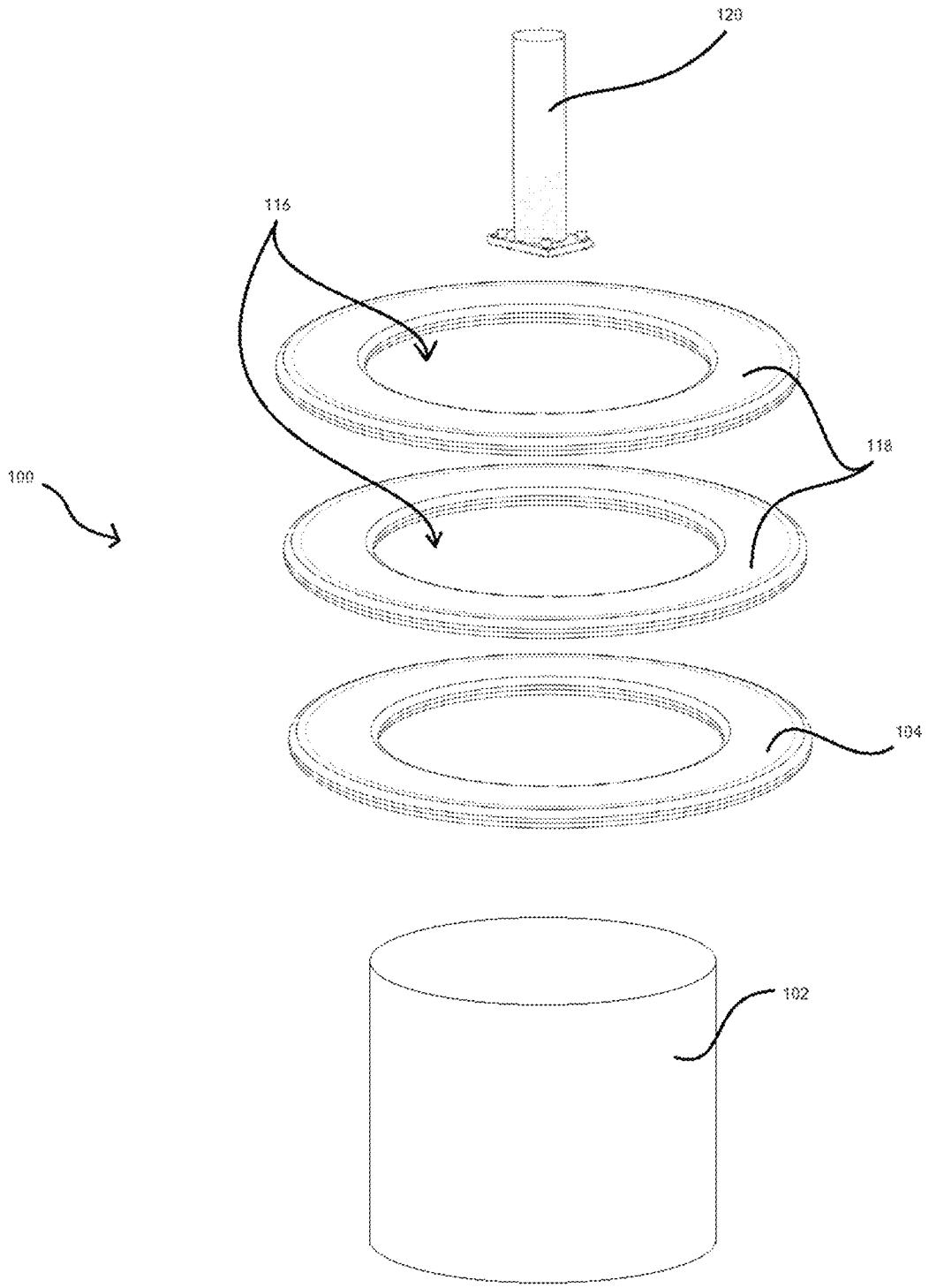
FIG. 4 is a perspective view of a structure base with sidewalls and a structure exploded therefrom.

An alternative embodiment of a method of fitting the protective barrier 100 on a structure base 102 may include removing a plurality of sidewalls 104, 118 from respective tires 106 (as shown in FIG. 1); stacking the plurality of sidewalls around the structure base with the structure base received in the inner opening 116 of the plurality of sidewalls; and attaching a structure 120 to the structure base. In such an embodiment, the sidewalls 104, 118 may be removed from the respective tires 106 and then left uncut such that the sidewalls remain in the form of continuous loops as shown in FIGS. 2-4. If the sidewalls 104, 118 are left uncut, the structure 120 may be attached to the structure base 102 after the plurality of sidewalls are stacked around the structure base in a manner such as that shown in FIG. 4. Alternative embodiments of the method may include splitting each of the plurality of sidewalls 104, 118 from an outer diameter 110 of each sidewall to the inner opening 116 of each sidewall as shown in FIGS. 6 and 7. In such embodiments, the structure 120 may be attached to the structure base 102 prior to stacking the plurality of sidewalls 104, 118 around the structure base.

Figure 5:
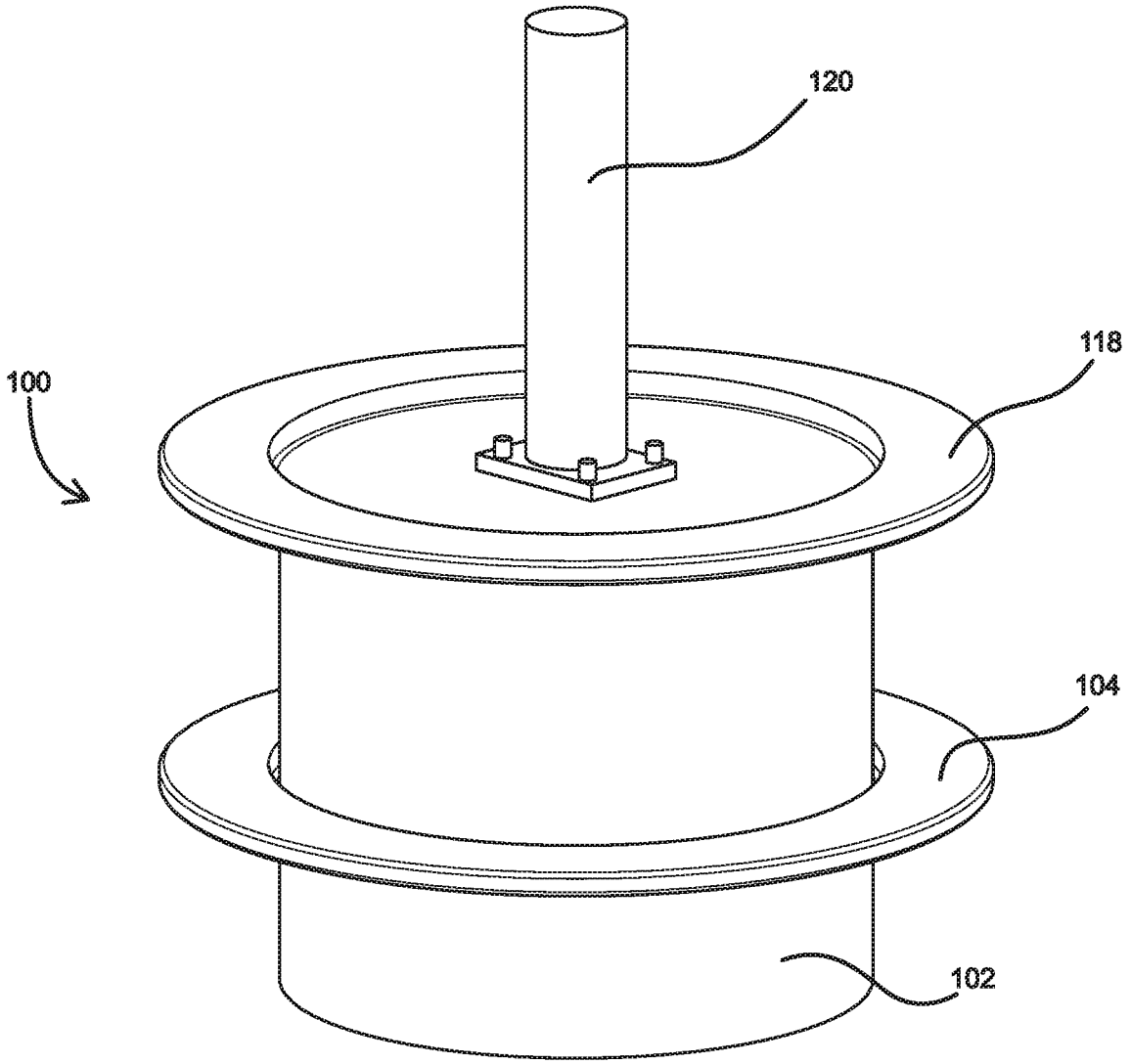
FIG. 5 is a perspective view of an embodiment of the structure base, sidewalls, and structure of FIG. 4 in an assembled configuration.
Figure 8:
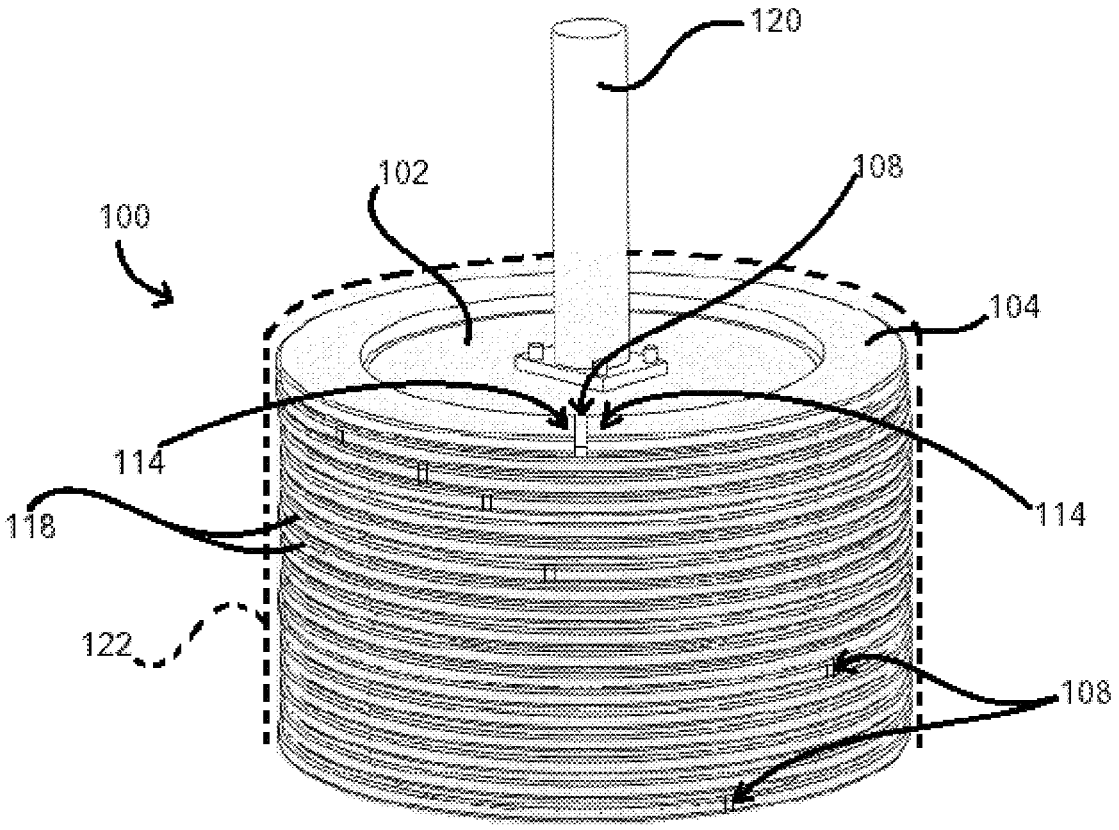
FIG. 8 is a perspective view of another embodiment of the structure base, sidewalls, and structure in an assembled configuration.

The present disclosure also relates to a protective barrier 100 and structure base 102 assembly such as the embodiments shown in FIGS. 5 and 8. The assembly may include the structure base 102 and at least one sidewall 104 removed from a tire 106. The sidewall 104 may be fitted on the structure base 102 such that the at least one sidewall substantially surrounds the structure base. The at least one sidewall 104 may further include a slit 108 from the sidewall inner diameter 112 to the sidewall outer diameter 110. Some embodiments may include a plurality of sidewalls 104, 118 removed from respective tires 106 and fitted on the structure base 102. Many embodiments may include the plurality of sidewalls 104, 118 stacked on top of each other, although some embodiments may include the sidewalls spaced apart along the structure base 102. In embodiments with multiple sidewalls 104, 118, the slit 108 of each sidewall is substantially unaligned with a majority of the slits of the other sidewalls. An ultraviolet protective layer may also be covering at least a portion of the at least one sidewall 104. The ultraviolet protective layer may cover at least a portion of all the sidewalls 104, 118 in embodiments including a plurality of sidewalls. A structure 120 may further be attached to the structure base 102 in some embodiments.

This written description uses examples to disclose the invention and also to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. While specific uses for the subject matter of the disclosure have been exemplified, other uses are contemplated. Therefore, the spirit and scope of the appended claims should not be limited to the description of the versions contained herein.

What is claimed is:

1. A method of fitting a protective barrier on a structure, the method comprising:

(a) removing a first sidewall from a tire;

(b) cutting a line spanning from an outer diameter of the sidewall to an inner diameter of the sidewall such that the sidewall includes sidewall ends and the sidewall is no longer a continuous loop;

(c) bending the sidewall ends away from each other to widen a gap between the sidewall ends to form a widened gap;

(d) placing the sidewall around the structure by moving the sidewall relative to the structure such that the structure passes through the widened gap and into an inner opening of the sidewall; and (e) returning the sidewall ends toward each other to narrow the widened gap to secure the sidewall about the structure.

2. The method of claim 1, further comprising:

repeating steps (a) through (d) with successive sidewalls; and stacking the successive sidewalls on the first sidewall such that a plurality of sidewalls is disposed around the structure.

3. The method of claim 2, further comprising:

fastening the sidewalls to each other.

4. The method of claim 2, wherein:

stacking the successive sidewalls includes staggering the cut lines of the sidewalls such that most of the cut lines do not align.

5. The method of claim 2, further comprising:

cutting the outer diameter of each of the sidewalls to a common outer diameter.

6. The method of claim 2, further comprising:

aligning the outer diameters of the stacked sidewalls.

7. The method of claim 2, further comprising:

aligning the inner diameters of the stacked sidewalls.

8. The method of claim 7, wherein:

aligning the inner diameters of the stacked sidewalls includes closely fitting the sidewalls to the structure.

9. The method of claim 2, wherein:

stacking the successive sidewalls includes stacking only sidewalls that have substantially similar inner diameters.

10. The method of claim 1, further comprising:

covering the sidewall with an ultraviolet protective layer.

11. The method of claim 1, wherein step (b) includes cutting the line along a radius of the sidewall.

* * * * *